US005528805A

United States Patent [19]

Leuchtenmüller et al.

[11] Patent Number: 5,528,805

[45] Date of Patent: Jun. 25, 1996

[54] CRANKING MECHANISM FOR A NEEDLE BOARD FOR NEEDLING A NONWOVEN WEB

[75] Inventors: Rudolf Leuchtenmüller, Schwertberg; Ludwig Legl, Buchkirchen, both of Austria

[73] Assignee: Textilmaschinenfabrik Dr. Ernst Fehrer Aktiengesellschaft, Leonding, Austria

[21] Appl. No.: 303,391

[22] Filed: Sep. 9, 1994

[30] Foreign Application Priority Data

| | | | |
|---|---|---|---|
| Sep. 13, 1993 | [AT] | Austria | A1842/93 |
| Feb. 21, 1994 | [AT] | Austria | A344/94 |

[51] Int. Cl.[6] ..... D04H 18/00

[52] U.S. Cl. ..... 28/115

[58] Field of Search ..... 28/107, 111, 113, 28/114, 115; 112/80.4, 80.42, 80.45, 221

[56] References Cited

U.S. PATENT DOCUMENTS

| | | | |
|---|---|---|---|
| 3,633,523 | 1/1972 | Card | 112/80.42 |
| 3,919,952 | 11/1975 | Lund | 112/80.42 |
| 5,186,133 | 2/1993 | Green | 112/80.42 |

FOREIGN PATENT DOCUMENTS

| | | | |
|---|---|---|---|
| 249392 | 1/1966 | Austria . | |
| 1435772 | 11/1968 | Germany | 28/107 |
| 2000617 | 7/1971 | Germany | 28/107 |
| 1044717 | 10/1966 | United Kingdom | 28/107 |
| 1375951 | 12/1974 | United Kingdom | 112/80.42 |

*Primary Examiner*—C. D. Crowder
*Assistant Examiner*—Larry D. Worrell, Jr.
*Attorney, Agent, or Firm*—Collard & Roe

[57] ABSTRACT

An apparatus which serves to needle a nonwoven web and comprises at least one needle beam for carrying at least one needle board, a rocker, which carries the needle beam and comprises at least two parallel arms, which are pivoted to a frame, and a slider-crank mechanism, which is coupled to the rocker or the needle beam. To permit an adjustment of the lift of the needle beam it is proposed that the slider-crank mechanism is adapted to be pivoted to the needle beam or the rocker at different distances from the pivotal axis of the rocker.

7 Claims, 3 Drawing Sheets

CRANKING MECHANISM FOR A NEEDLE BOARD FOR NEEDLING A NONWOVEN WEB

BACKGROUND OF THE INVENTION

1. Field of the Invention

This invention relates to an apparatus for needling a nonwoven web, comprising at least one needle beam for carrying at least one needle board, a rocker, which carries the needle beam and comprises at least two parallel arms, which are pivoted to a frame, and a slider-crank mechanism, which is coupled to the rocker or the needle beam, the needle beam and rocker constituting needle board-actuating means.

2. Description of the Prior Art

Needle boards can be driven by slider-crank mechanisms either by means of push rods, which are slidably mounted on slide tracks and to which the needle beams are secured, which carry the needle boards, or by means of rockers, which carry the needle beams and to which the slider-crank mechanisms are pivoted British Patent Specification 1,044,717). The use of a rocker for guiding the needle beams will afford the advantage that the structure is simplified because it is no longer necessary to provide push rods and associated slide tracks between the connecting rods of the slider-crank mechanisms and the rockers. But the provision of a simple rocker requires that the needles are moved along an arc of a circle. Because the length of the rocker levers is large relative to the oscillation amplitude of the rocker, that guidance along an arc will hardly affect the result of the needling operation and may even improve the felting of the nonwoven web in some cases.

In order to permit an influence to be exerted on the result of the needling operation, it is desirable to change the lift of a needle beam which is driven by a slider-crank mechanism. This is generally effected by an adjustment of the eccentricity of the eccentric shaft which carries the connecting rods. That adjustment will also be possible, in principle, if the needle beam is guided by a rocker but this will involve a considerable structural expenditure.

SUMMARY OF THE INVENTION

For this reason it is an object of the invention to provide for the needling of a nonwoven web an apparatus which is of the kind described first hereinbefore and is so designed that an adjustment of the lift of the needle beam and of the needle board carried by the needle beam can be effected with simple structural means.

That object is accomplished in accordance with the invention in that the slider-crank mechanism is adapted to be pivoted selectively to the needle board-actuating means, that is, to the needle beam or the rocker, at different distances from the pivotal axis of the rocker.

Because the slider-crank mechanism can selectively be pivoted to the rocker or needle beam at any of a plurality of locations, the radius of the pivotal movement of the pivot can be changed so that the oscillation amplitude of the rocker can be changed and, as a result, the lift of the needles can be changed as desired. This is due to the fact that the stroke between the inner and outer dead center positions of the slider-crank mechanism will remain constant. That adjustment may continuously be effected by a corresponding displacement of the location at which the slider-crank mechanism is pivoted to the rocker. But a simpler design, which will meet the usual requirements, will be obtained if the rocker is provided with a plurality of pivotal connecting means, which may selectively be employed.

The mere displacement of the means by which the slider-crank mechanism is pivoted to the rocker will involve a change of the angular orientation of the connecting rods of the slider-crank mechanism and, as a result, a change of the velocity profile as the needles penetrate into the nonwoven web and are pulled out of the nonwoven web. That influence can be suppressed according to a further feature of the invention in that the slider-crank mechanism is adapted to be selectively pivotally connected to said needle beam or said rocker at any of a plurality of locations spaced different distances from said pivotal axis along a row and the slider-crank mechanism is mounted to be displaceable along said row over a distance which is equal to the distance between the extreme ones of said locations. Constant conditions for driving the slider-crank mechanism will be ensured if the crankshaft or eccentric shaft of the slider-crank mechanism can thus be shifted in unison with the pivotal connection.

If the slider-crank mechanism comprises a crankshaft or eccentric shaft which is connected to a drive and rotatably mounted on a carrier mounted on the frame and the carrier for mounting the crankshaft or eccentric shaft is mounted to be displaceable along said row over a distance which is equal to the distance between the extreme ones of said locations, a particularly simple design will be achieved because the adjustment can be effected in that only the carrier of the frame is displaced. If the drive for the crankshaft or eccentric shaft is also mounted on the displaceable carrier mounted on the frame, it will not be necessary to effect a change adjacent to the means by which the drive is connected to the crankshaft or eccentric shaft.

DETAILED DESCRIPTION OF THE PREFERRED EMBODIMENTS

Figure 1:
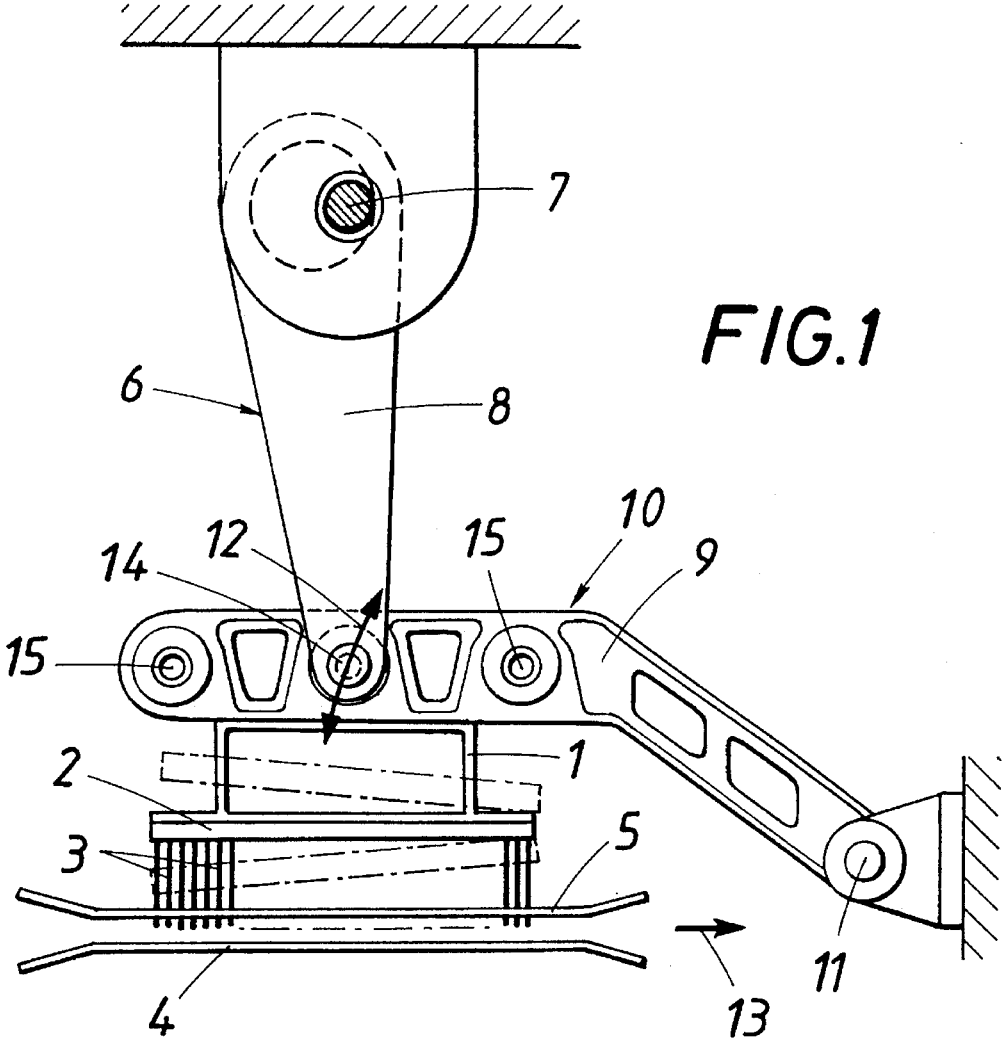
FIG. 1 is a schematic side elevation showing an apparatus in accordance with the invention for the needling of a nonwoven web.

The invention will now be explained more in detail with reference to illustrative embodiments shown on the drawing.

Figure 2:
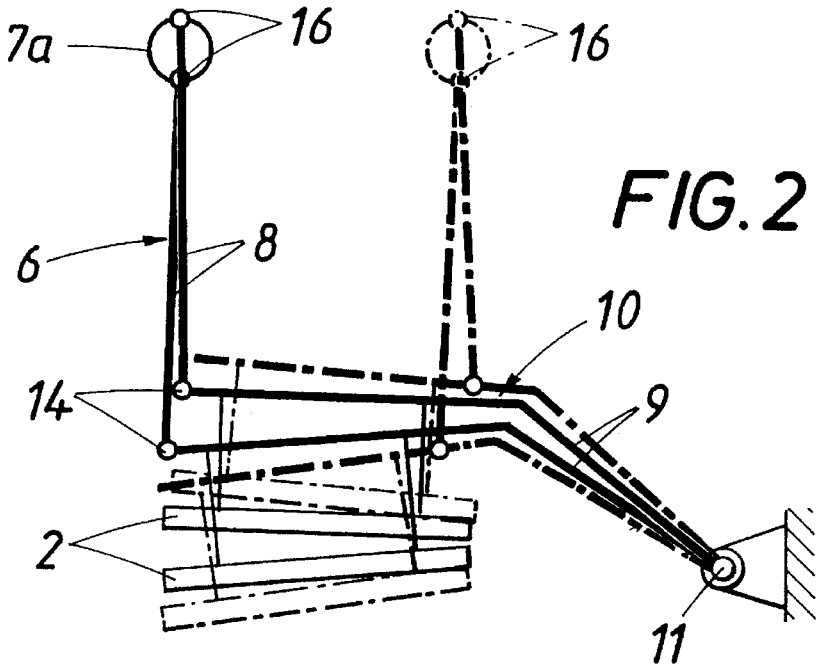
FIG. 2 is a basic sketch illustrating that apparatus with two different lift settings.

As shown in FIG. 1, an apparatus in accordance with the invention for needling a nonwoven web comprises in the usual manner at least one needle board 2, which is mounted on a needle beam 1 and comprises needles 3, which penetrate into a nonwoven web, which is guided between a web support 4 and a stripper 5. The web support 4 and the stripper 5 consist of perforated plates, through which the needles can be moved. The needle board is driven by a slider-crank mechanism 6, which in the conventional manner comprises a crankshaft or eccentric shaft 7 and at least two connecting rods 8, which are pivoted to said crankshaft or eccentric shaft 7. For the sake of clearness the crankshaft or eccentric shaft is indicated in FIG. 2 only by the flight circle 7*a* of the crankpin. The connecting rods 8 are pivoted to parallel arms 9 of a rocker 10, which is connected to the frame 20 (FIG. 3) by a pivotal axis 11. Because the needle beam 1 is secured to the rocker 10, the needle board 2 is moved up and down about the pivotal axis 11 along an arc of a circle 12 by the rocker 10, which is driven by the slider-crank mechanism 6. This is illustrated in FIG. 1 by the top and bottom dead center positions indicated in phantom. If two or more needle boards are provided, which are arranged in a row that extends transversely to the direction of travel 15 of the nonwoven web, each needle board will similarly be guided by the rocker 10 and driven by the slider-crank mechanism 6. Alternatively, FIG. 4 shows an embodiment which differs from that of FIG. 1 only in that pivot bearings 15 are arranged on needle beam 1, rather than on rocker 10.

To permit the lift between the top-and bottom dead center positions to be adjusted in a simple manner, the pivot 14 connecting the connecting rods 8 of the slider-crank mechanism to the rocker 10 can be adjusted along the arms 9 of the rocker 10. For that purpose, pivot bearings 15, which are spaced different distances from the pivotal axis 11, are provided on the arms 9 of the rocker 10 so that the connecting rods 8 may selectively be pivoted at any of said pivot bearings 15. The effect of such a change of the location of the pivotal connection is illustrated in the basic sketch of FIG. 2. If the pivot 14 of the slider-crank mechanism 8 has been inserted into a pivot bearing 15 which is remote from the pivotal axis 11, as is indicated by solid lines, the oscillation amplitude of the rocker 10 will be relatively small as well as the distance between the top and bottom dead center positions of the needle board 2. If the pivotal connection is closer to the pivotal axis 11, the rocker 10 will have a larger oscillation amplitude because the slider-crank mechanism 6 will not be changed, and the dead center positions 16 will remain at least substantially unchanged if the crankshaft or eccentric shaft 7 is displaced in unison.

Figure 3:
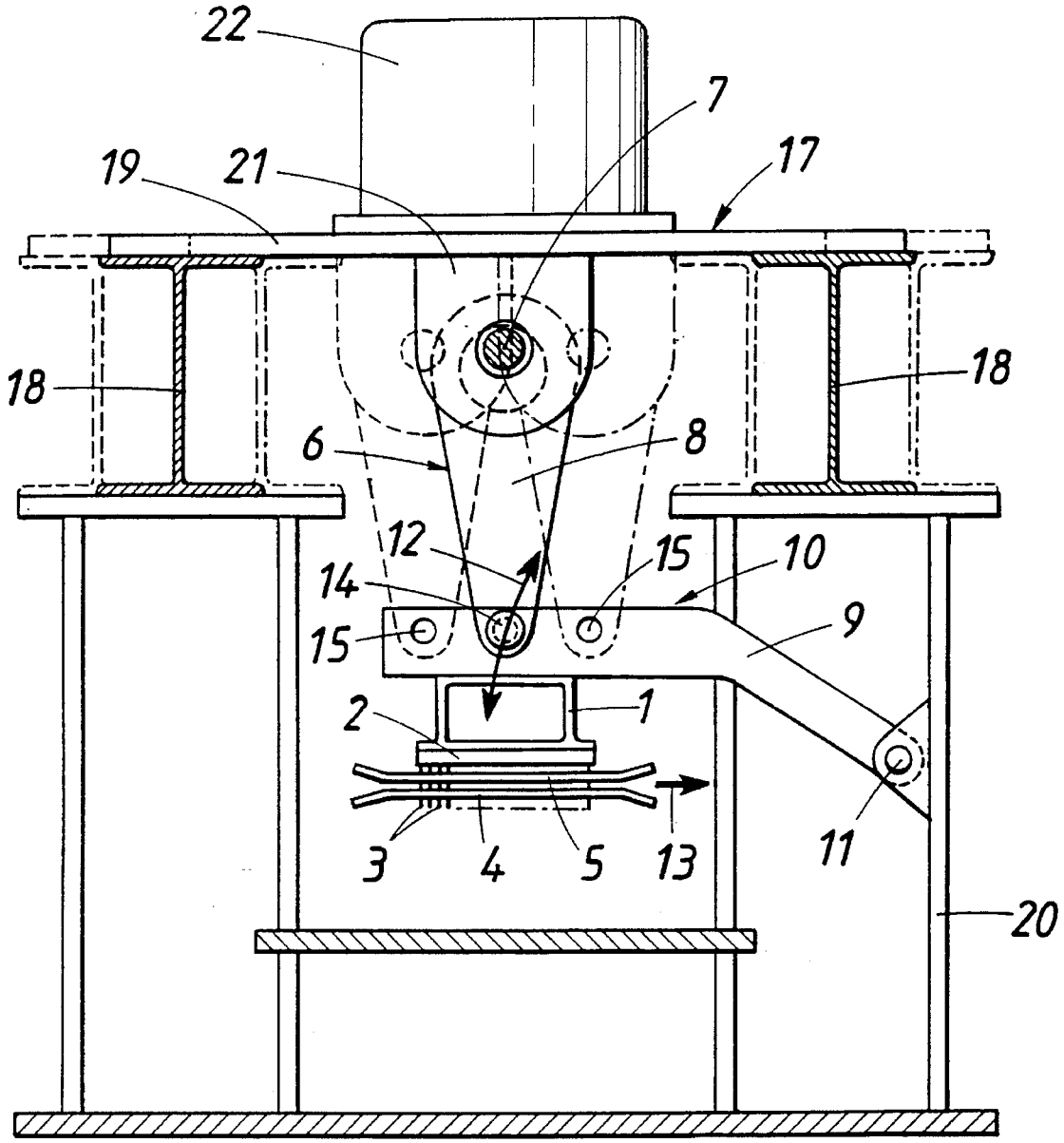
FIG. 3 is a simplified longitudinal sectional view showing a modified design of an apparatus in accordance with the invention for needling a nonwoven web.
Figure 4:
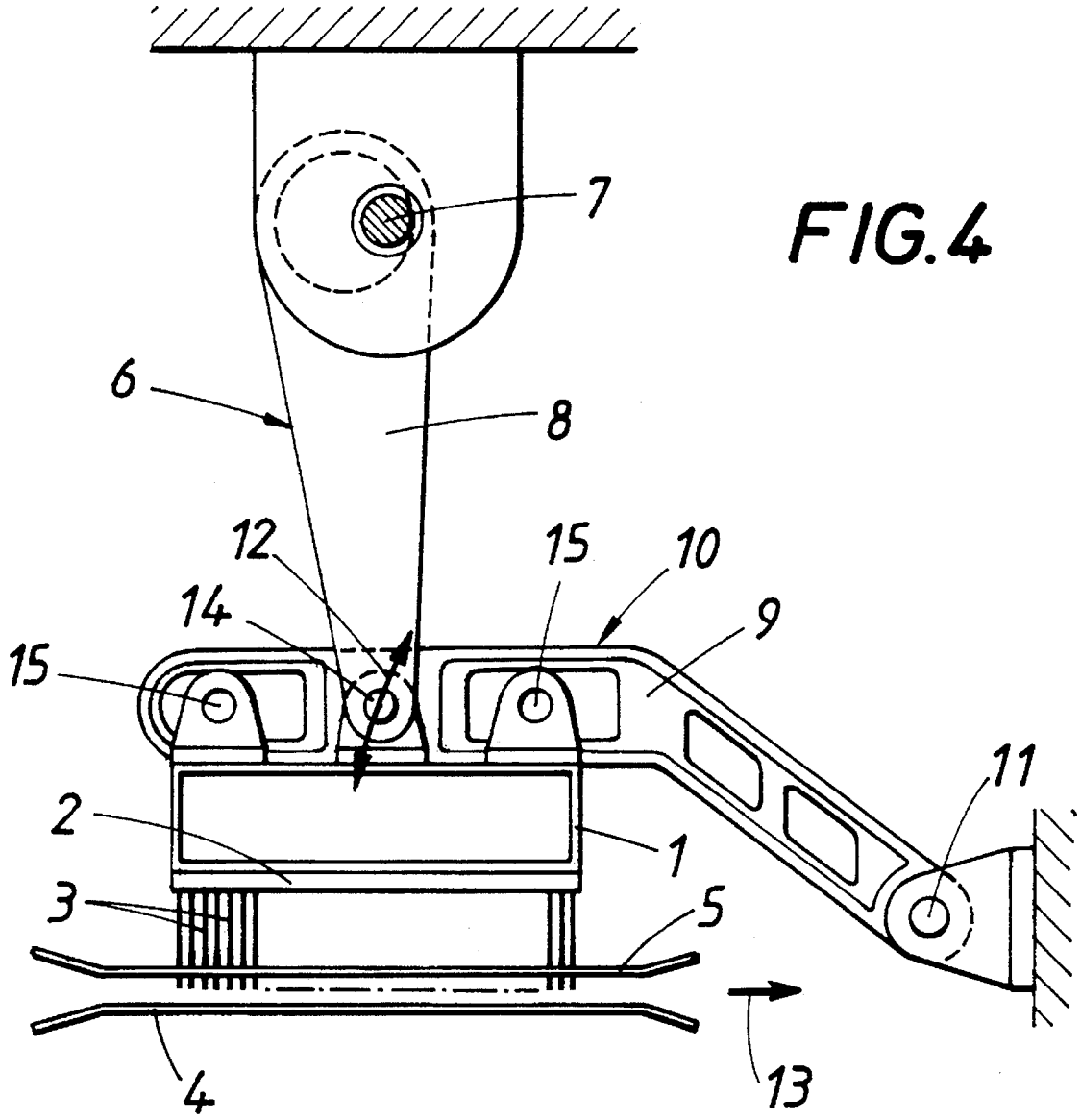
FIG. 4 corresponds to FIG. 1 and shows a modification.

A simple design of the means for displacing the crankshaft or eccentric shaft 7 is shown in FIG. 3. The crankshaft or eccentric shaft 7 is rotatably mounted on a carrier 17, which comprises two profiled carrier beams 18 and yokes 19, which interconnect said carrier beams 18. That carrier 17 is adapted to be displaced on the frame 20 of the apparatus. As the slider-crank mechanism 6 is displaced from the intermediate pivoted position represented by solid lines and is pivoted at a pivot bearing 15 which is more remote from the axis of rotation 11, as is indicated in phantom, whereas the throw of the eccentric will remain the same, the oscillation amplitude of the rocker 10 will be reduced as well as the distance between the top and bottom dead center positions of the needle board 2. If the pivotal connection is nearer to the axis of rotation 11 the oscillation amplitude of the rocker 10 will be increased as is illustrated in phantom. Because the frame-mounted carrier 17 is displaced too, it is not necessary to displace the crankshaft or eccentric shaft 7 by the associated bearing housing 21 so that the apparatus can be altered by a relatively simple adjustment.

The needle beam 1 and the rocker 10 constitute needle board-actuating means, to which the slider-crank mechanism 6 is coupled, which is operable to oscillate the needle board-actuating means 1, 10 about the pivotal axis 11. Pivotal connecting means 14, 15 are provided for selectively pivotally connecting said slider-crank mechanism 6 to said needle board-actuating means 1, 10 at any of a plurality of locations spaced different distances from said pivotal axis along a row. The slider-crank mechanism 6 is mounted on the frame 20 to be displaceable along said row over a distance which is equal to the distance between the extreme ones of said locations. Specifically the carrier 17 is mounted on the frame 20 to be displaceable along said row over a distance which is equal to the distance between the extreme ones of said locations. The slider-crank mechanism 6 comprises a crankshaft 7, which is rotatably mounted on the carrier 17 and is adapted to be driven by a drive, means 22 which is also mounted on said carrier 17.

We claim:

1. An apparatus for needling a nonwoven web, comprising at least one needle beam, at least one needle board mounted on said at least one needle beam, a frame, a rocker, which carries said at least one needle beam and comprises at least two parallel arms, which are pivoted to said frame on a pivotal axis, said at least one needle beam and said rocker constituting needle board-actuating means, and a slider-crank mechanism connected to said needle board-actuating means and operable to oscillate said needle board-actuating means about said pivotal axis, wherein the improvement comprises a plurality of pivotal connecting means for selectively pivotally connecting said slider-crank mechanism to said needle board-actuating means, respective ones of said pivotal connecting means being arranged at locations spaced at different distances from said pivotal axis.

2. The improvement set forth in claim 1, wherein said pivotal connecting means are adapted to selectively pivotally connect said slider-crank mechanism to said at least one needle beam.

3. The improvement set forth in claim 1, wherein said pivotal connecting means are adapted to pivotally connect said slider-crank mechanism to said rocker.

4. The improvement set forth in claim 1, wherein said pivotal connecting means are aligned in a row and said slider-crank mechanism is mounted on said frame to be displaceable along said row over a distance which is equal to the distance between extreme ones of said locations in said row.

5. The improvement set forth in claim 4, wherein a carrier is mounted on said frame to be displaceable along said row over a distance which is equal to the distance between the extreme locations, said slider-crank mechanism comprises a crankshaft, which is rotatably mounted on said carrier, and drive means are provided for rotating said crankshaft.

6. The improvement set forth in claim 5, wherein said crankshaft is an eccentric shaft.

7. The improvement set forth in claim 5, wherein said drive means are mounted on said carrier.

* * * * *